US009896932B2

(12) United States Patent
Chiang

(10) Patent No.: US 9,896,932 B2
(45) Date of Patent: Feb. 20, 2018

(54) CUTTING TOOL HOLDING DEVICE

(71) Applicant: EVERPADS CO., LTD., Taichung (TW)

(72) Inventor: Chun-Li Chiang, Taichung (TW)

(73) Assignee: EVERPADS CO., LTD., Taichung (TW)

( * ) Notice: Subject to any disclaimer, the term of this patent is extended or adjusted under 35 U.S.C. 154(b) by 188 days.

(21) Appl. No.: 14/896,404

(22) PCT Filed: Jun. 20, 2014

(86) PCT No.: PCT/CN2014/080449

§ 371 (c)(1),
(2) Date: Dec. 7, 2015

(87) PCT Pub. No.: WO2014/202029

PCT Pub. Date: Dec. 24, 2014

(65) Prior Publication Data

US 2016/0123144 A1 May 5, 2016

(30) Foreign Application Priority Data

Jun. 21, 2013 (CN) ..... 2013 2 0360193 U

(51) Int. Cl.
*E21C 35/193* (2006.01)
*E21C 35/19* (2006.01)

(52) U.S. Cl.
CPC ..... *E21C 35/193* (2013.01); *E21C 35/1933* (2013.01); *E21C 2035/191* (2013.01)

(58) Field of Classification Search
CPC .. E21C 2035/191; E21C 35/19; E21C 35/193; E21C 35/1933; E21C 35/1936
See application file for complete search history.

(56) References Cited

U.S. PATENT DOCUMENTS 2,949,946 A * 8/1960 Johnson ..... B27B 33/20 144/162.1
4,275,929 A * 6/1981 Krekeler ..... E21C 35/18 299/102
5,186,575 A * 2/1993 Wirtgen ..... B28D 1/188 198/676

(Continued)

FOREIGN PATENT DOCUMENTS

DE 20306065 U1 6/2003
EP 1186744 A2 * 3/2002 ..... B28D 1/188

(Continued)

*Primary Examiner* — John J Kreck
*Assistant Examiner* — Michael A Goodwin
(74) *Attorney, Agent, or Firm* — CKC & Partners Co., Ltd.

(57) ABSTRACT

A cutting tool holding device includes a base, a cutting tool holder, a screw element, a fitting positioning element and a pulling element. The base includes an accommodating groove, a receiving hole and a fitting positioning hole. The cutting tool holder includes a holder and a cutting tool receiving component. The holder includes an engaging portion detachably engaged in the accommodating groove, and a concave portion communicated with the fitting positioning hole is formed on the engaging portion. The fitting positioning element is driven by the pulling element to move in the fitting positioning hole for pressing against the concave portion tightly.

12 Claims, 16 Drawing Sheets

(56) References Cited

U.S. PATENT DOCUMENTS

| | | | | |
|---|---|---|---|---|
| 5,607,206 | A * | 3/1997 | Siddle | E21C 35/19<br>299/102 |
| 2005/0098015 | A1* | 5/2005 | Latham | E21C 35/1936<br>83/698.41 |
| 2005/0127742 | A1 | 6/2005 | Erickson | |
| 2007/0114835 | A1* | 5/2007 | Latham | B28D 1/188<br>299/102 |
| 2009/0085396 | A1* | 4/2009 | Chiang | B28D 1/188<br>299/102 |

FOREIGN PATENT DOCUMENTS

| | | | |
|---|---|---|---|
| EP | 2048323 | A1 | 4/2009 |
| EP | 2612984 | A2 | 7/2013 |
| EP | 2626508 | A2 | 8/2013 |

* cited by examiner

CUTTING TOOL HOLDING DEVICE

CROSS-REFERENCE TO RELATED APPLICATION

This application is a continuation of International application No. PCT/CN2014/080449, filed Jun. 20, 2014 which claims the benefits of priority of CN application No. 201320360193.2 filed on Jun. 21, 2013, the content of which are incorporated herein by reference.

BACKGROUND

Technical Field

The present disclosure relates to a cutting tool holding device. More particularly, the present disclosure relates to a cutting tool holding device mounted on a road milling machine, a machine for rotating, digging or drilling or a grinding tool.

Description of Related Art

A cutting tool holding device is configured to receive a cutting tool and is mounted on a machinery, such as a road milling machine, for applying a surface roughness treatment to a road, such as scraping, crushing or drilling, or for excavating mines.

Conventionally, a cutting tool holding device includes a base and a cutting tool holder. The base is fixed on a peripheral surface of a working member (such as a roller) of a machinery, and the cutting tool holder for receiving the cutting tool is fixed on the base by some fastening members. The cutting tool received in the cutting tool holder is mounted along a tangent of the base, which is favorable for applying a drilling force or a scraping force on the processed material (such as concrete or asphalt on a road). Therefore, when the road milling machine is working, a drilling operation is first applied to the processed material by the cutting tool. As the roller rotates, a scraping operation is then applied to the processed material by the cutting tool so as to destroy the processed material.

However, the processed material usually has a solid structure, and a reaction force generated from the processed material exerts on the cutting tool. As a result, a lifetime of the cutting tool is rather limited. Furthermore, when the cutting tool holder and the base are not firmly assembled, the cutting tool holder and the base collide with each other due to the aforementioned reaction force, and the cutting tool holder and the base are damaged thereby. As a result, a lifetime of the cutting tool holder and the base are shortened. The cost for replacing and maintaining the cutting tool holder and the base are increased significantly.

Therefore, how to reinforce the assembling stability between the base and the cutting tool holder so as to enhance the load value for the reaction force, prolong the lifetime of the cutting tool holder and the base, and reduce the maintaining cost is the goal of the related industries.

SUMMARY

According to one object of the present disclosure, a cutting tool holding device is provided. The cutting tool holding device includes a base, a cutting tool holder, a fitting positioning element and a pulling element. The base includes a fitting positioning hole, and the cutting tool holder includes an engaging portion. The fitting positioning element has a cross-sectional area changing gradually along an extending direction thereof. The fitting positioning element is driven by the pulling element to move in the fitting positioning hole, so that a pressing degree between the fitting positioning element and the engaging portion can be changed. Therefore, the assembling stability between the base and the cutting tool holder can be reinforced, which can enhance the load value for the reaction force of the base and the cutting tool holder, and can further to prolong the lifetime of the cutting tool holder and the base and reduce the cost of replacement and maintenance.

According to another object of the present disclosure, a cutting tool holding device is provided. The cutting tool holding device includes a base, a cutting tool holder, a tube positioning element and a dragging element. The base includes a tube positioning hole, and the cutting tool holder includes a fitting tube. The tube positioning element has a cross-sectional area changing gradually along an extending direction thereof. The tube positioning element is driven by the dragging element to move in the tube positioning hole, so that a pressing degree between the tube positioning element and the fitting tube can be changed. Therefore, the assembling stability between the base and the cutting tool holder can be reinforced, which can enhance the load value for the reaction force of the base and the cutting tool holder, and can further to prolong the lifetime of the cutting tool holder and the base and reduce the cost of replacement and maintenance.

According to one embodiment of the present disclosure, a cutting tool holding device is provided. The cutting tool holding device is for holding a cutting tool. The cutting tool holding device includes a base, a cutting tool holder, a fitting positioning element and a pulling element.

The base includes a first abutting portion, a second abutting portion and a fitting positioning hole, wherein the first abutting portion has an accommodating groove formed thereon, the second abutting portion is connected with the first abutting portion and defines an angle with the first abutting portion. The angle is greater than or equal to 60 degrees and is less than or equal to 120 degrees. A receiving hole is formed on the second abutting portion, and a central axis of the receiving hole is parallel to an extending direction of the accommodating groove. The fitting positioning hole is through the base and communicated with the accommodating groove, and a central axis of the fitting positioning hole is perpendicular to the extending direction of the accommodating groove.

The cutting tool holder is assembled between the first abutting portion and the second abutting portion of the base. The cutting tool holder includes a holder and a cutting tool receiving component. The holder includes a fitting hole and an engaging portion. The fitting hole is correspondent to the receiving hole. The engaging portion is detachably engaged in the accommodating groove. A concave portion is formed on the engaging portion, and the concave portion is communicated with the fitting positioning hole while the engaging portion is engaged in the accommodating groove. The cutting tool receiving component includes a fitting tube and a holding hole. The fitting tube is fitted into the fitting hole of the holder and the receiving hole of the second abutting portion, and the holding hole is coaxial with the fitting tube and is for holding the cutting tool.

The fitting positioning element is movably disposed in the fitting positioning hole. The fitting positioning element is configured to press against the concave portion of the engaging portion. A first screw hole is formed at an end of the fitting positioning element, and the fitting positioning element has a cross-sectional area changing gradually along an extending direction thereof.

The pulling element is restrictedly disposed in the fitting positioning hole. The pulling element includes a first screw portion, the first screw portion is engaged with the first screw hole, whereby the fitting positioning element is driven by the pulling element to move in the fitting positioning hole for changing a pressing degree between the fitting positioning element and the concave portion of the engaging portion.

According to the aforementioned cutting tool holding device, the base can further include a fixing screw hole communicated with the receiving hole. The cutting tool holding device can further include a screw element screwed in the fixing screw hole, and the screw element is configured to abut and fix the fitting tube of the cutting tool receiving component.

According to the aforementioned cutting tool holding device, the fitting positioning hole can include a first narrow portion, and the fitting positioning element is disposed at a side of the first narrow portion. The pulling element can further include a first position-limited portion connected with the first screw portion, a cross-sectional area of the first position-limited portion is greater than a cross-sectional area of the first narrow portion, the position-limited portion is disposed at the other side of the first narrow portion, and the first screw portion inserts through the first narrow portion and is engaged with the first screw hole of the fitting positioning element.

According to the aforementioned cutting tool holding device, the angle defined by the first abutting portion and the second abutting portion can be 90 degrees.

According to the aforementioned cutting tool holding device, the fitting positioning element can further include a first inclined plane formed on an outer surface thereof, and the first inclined plane is configured to press against the concave portion of the engaging portion. The concave portion of the engaging portion can include a second inclined plane, and the first inclined plane of the fitting positioning element is configured to press against the second inclined plane.

According to another embodiment of the present disclosure, a cutting tool holding device is provided. The cutting tool holding device is for holding a cutting tool. The cutting tool holding device includes a base, a cutting tool holder, a fitting positioning element and a pulling element.

The base includes a first abutting portion, a second abutting portion and a fitting positioning hole. The first abutting portion has an accommodating groove formed thereon. The second abutting portion is connected with the first abutting portion and defines an angle with the first abutting portion. The angle is greater than or equal to 60 degrees and is less than or equal to 120 degrees. A receiving hole is formed on the second abutting portion, and a central axis of the receiving hole is parallel to an extending direction of the accommodating groove. A fitting positioning hole is through the base and communicated with the accommodating groove, and a central axis of the fitting positioning hole is perpendicular to the extending direction of the accommodating groove.

The cutting tool holder is assembled between the first abutting portion and the second abutting portion of the base. The cutting tool holder includes an engaging portion, a fitting tube and a holding hole. The engaging portion is detachably engaged in the accommodating groove. A concave portion is formed on the engaging portion, and the concave portion is communicated with the fitting positioning hole while the engaging portion is engaged in the accommodating groove. The fitting tube is fitted into the receiving hole of the second abutting portion. The holding hole is coaxial with the fitting tube and is for holding the cutting tool.

The fitting positioning element is movably disposed in the fitting positioning hole. The fitting positioning element is configured to press against the concave portion of the engaging portion. A first screw hole is formed at an end of the fitting positioning element. The fitting positioning element has a cross-sectional area changing gradually along an extending direction thereof.

The pulling element is restrictedly disposed in the fitting positioning hole. The pulling element includes a first screw portion, the first screw portion is engaged with the first screw hole, whereby the fitting positioning element is driven by the pulling element to move in the fitting positioning hole for changing a pressing degree between the fitting positioning element and the concave portion of the engaging portion.

According to the aforementioned cutting tool holding device, the base can further include a fixing screw hole communicated with the receiving hole. The cutting tool holding device can further include a screw element screwed in the fixing screw hole. The screw element is configured to abut and fix the fitting tube of the cutting tool receiving component.

According to the aforementioned cutting tool holding device, the base can further include a tube positioning hole through the base and communicated with the receiving hole, and a central axis of the tube positioning hole is perpendicular to a central axis of the receiving hole. A depressed portion can be formed on the fitting tube of the cutting tool holder. The depressed portion is communicated with the tube positioning hole while the fitting tube is fitted into the receiving hole. The cutting tool holding device can further include a tube positioning element movably disposed in the tube positioning hole. The tube positioning element is configured to press against the depressed portion of the fitting tube. A second screw hole is formed at an end of the tube positioning element. The tube positioning element has a cross-sectional area changing gradually along an extending direction thereof. The cutting tool holding device can further include a dragging element restrictedly disposed in the tube positioning hole. The dragging element includes a second screw portion, the second screw portion is engaged with the second screw hole, whereby the tube positioning element is driven by the dragging element to move in the tube positioning hole for changing a pressing degree between the tube positioning element and the depressed portion of the fitting tube.

According to the aforementioned cutting tool holding device, the fitting positioning element can further include a first inclined plane formed on an outer surface thereof, and the first inclined plane is configured to press against the concave portion of the engaging portion. The tube positioning element can further include a third inclined plane formed on an outer surface thereof, and the third inclined plane is configured to press against the depressed portion of the fitting tube. The concave portion of the engaging portion can include a second inclined plane, and the first inclined plane of the fitting positioning element is configured to press against the second inclined plane. The depressed portion of the fitting tube can include a fourth inclined plane, and the third inclined plane of the tube positioning element is configured to press against the fourth inclined plane.

According to the aforementioned cutting tool holding device, the angle defined by the first abutting portion and the second abutting portion can be 90 degrees.

According to yet another embodiment of the present disclosure, a cutting tool holding device is provided. The cutting tool holding device is for holding a cutting tool. The cutting tool holding device includes a base, a cutting tool holder, a tube positioning element and a dragging element.

The base includes a receiving hole and a tube positioning hole. The tube positioning hole is through the base and communicated with the receiving hole, and a central axis of the tube positioning hole is perpendicular to a central axis of the receiving hole.

The cutting tool holder is assembled with the base. The cutting tool holder includes a fitting tube and a holding hole. The fitting tube is fitted into the receiving hole. A depressed portion is formed on the fitting tube, and the depressed portion is communicated with the tube positioning hole while the fitting tube is fitted into the receiving hole. The holding hole is coaxial with the fitting tube and is for holding the cutting tool.

The tube positioning element is movably disposed in the tube positioning hole. The tube positioning element is configured to press against the depressed portion of the fitting tube. A second screw hole is formed at an end of the tube positioning element. The tube positioning element has a cross-sectional area changing gradually along an extending direction thereof.

The dragging element is restrictedly disposed in the tube positioning hole. The dragging element includes a second screw portion, the second screw portion is engaged with the second screw hole, whereby the tube positioning element is driven by the dragging element to move in the tube positioning hole for changing a pressing degree between the tube positioning element and the depressed portion of the fitting tube.

According to the aforementioned cutting tool holding device, the tube positioning element can further include a third inclined plane formed on an outer surface thereof, and the third inclined plane is configured to press against the depressed portion of the fitting tube. The depressed portion of the fitting tube can include a fourth inclined plane, and the third inclined plane of the tube positioning element is configured to press against the fourth inclined plane.

According to the aforementioned cutting tool holding device, a number of the tube positioning holes of the base can be two. The tube positioning holes are separately through the base. Each of the tube positioning holes is communicated with the receiving hole, and a central axis of each of the tube positioning holes is perpendicular to the central axis of the receiving hole. A number of the depressed portions formed on the fitting tube can be two, and the two depressed portions are communicated with the two tube positioning holes respectively while the fitting tube is fitted into the receiving hole. A number of the tube positioning elements can be two. The two tube positioning elements are movably disposed in the two tube positioning holes respectively, and the two tube positioning elements are configured to press against the two depressed portions of the fitting tube respectively. A number of the dragging elements can be two, and the two dragging elements are restrictedly disposed in the two tube positioning holes respectively.

BRIEF DESCRIPTION OF THE DRAWINGS

The disclosure can be more fully understood by reading the following detailed description of the embodiment, with reference made to the accompanying drawings as follows.

DETAILED DESCRIPTION

Figure 1:
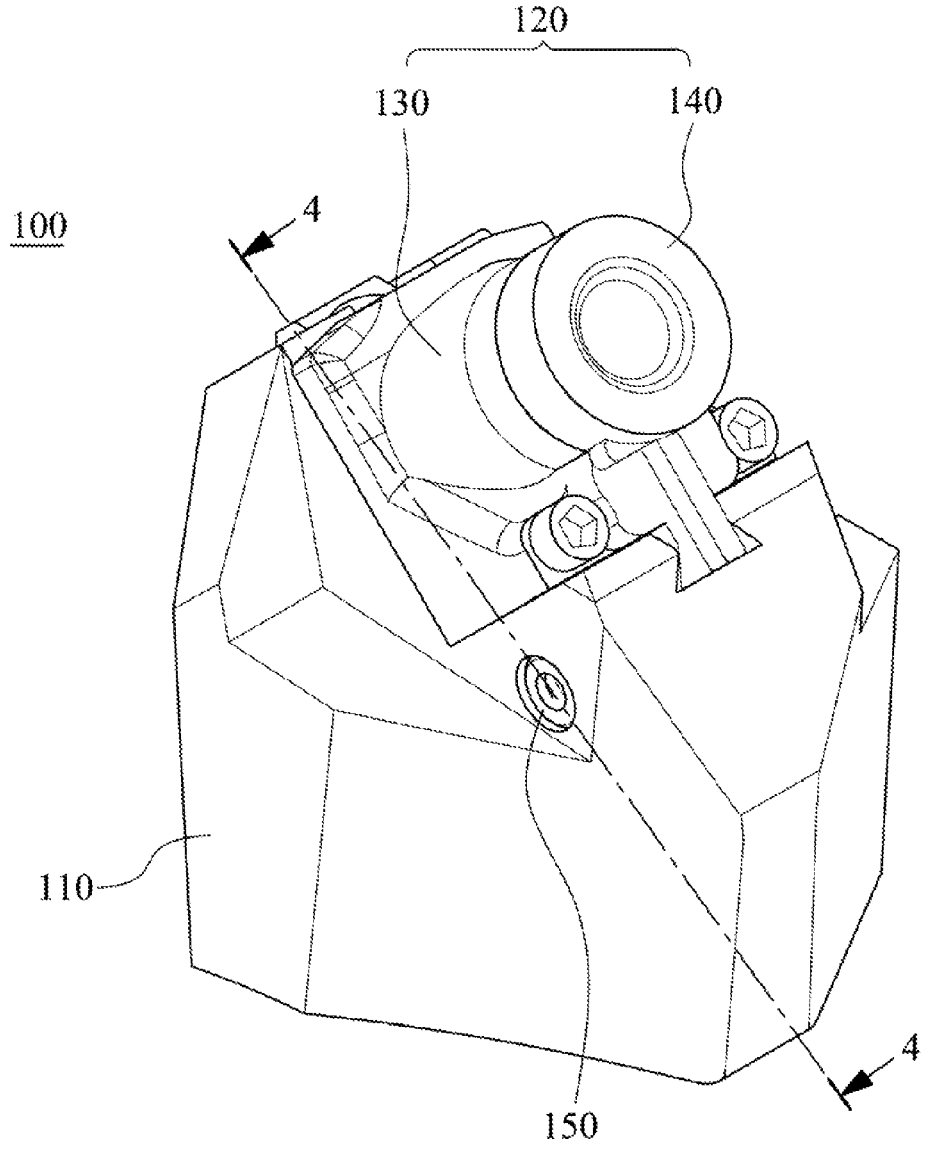
FIG. 1 is a three-dimensional view of a cutting tool holding device according to the 1st embodiment of the present disclosure.
Figure 2:
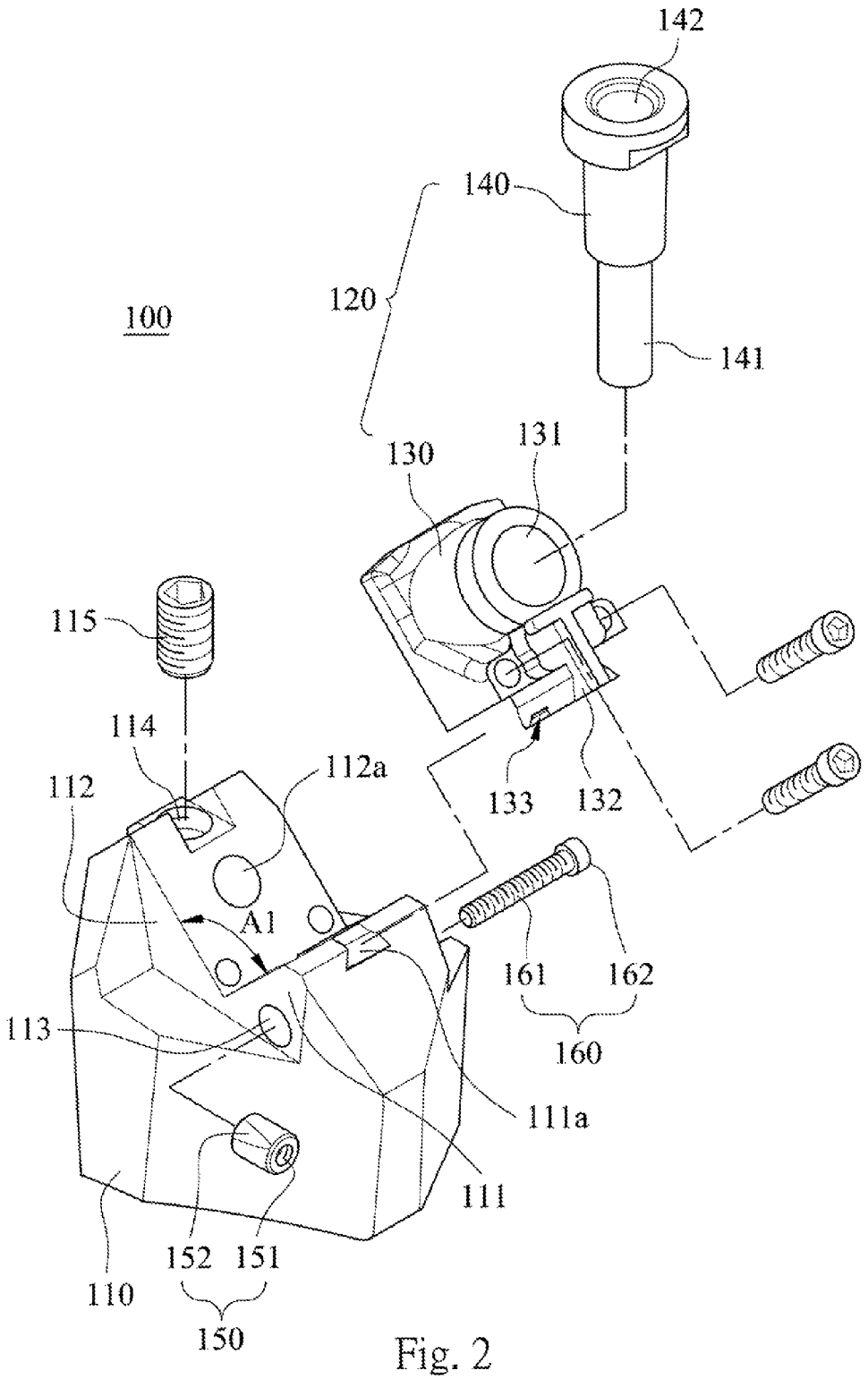
FIG. 2 is an exploded view of the cutting tool holding device shown in FIG. 1.
Figure 3:
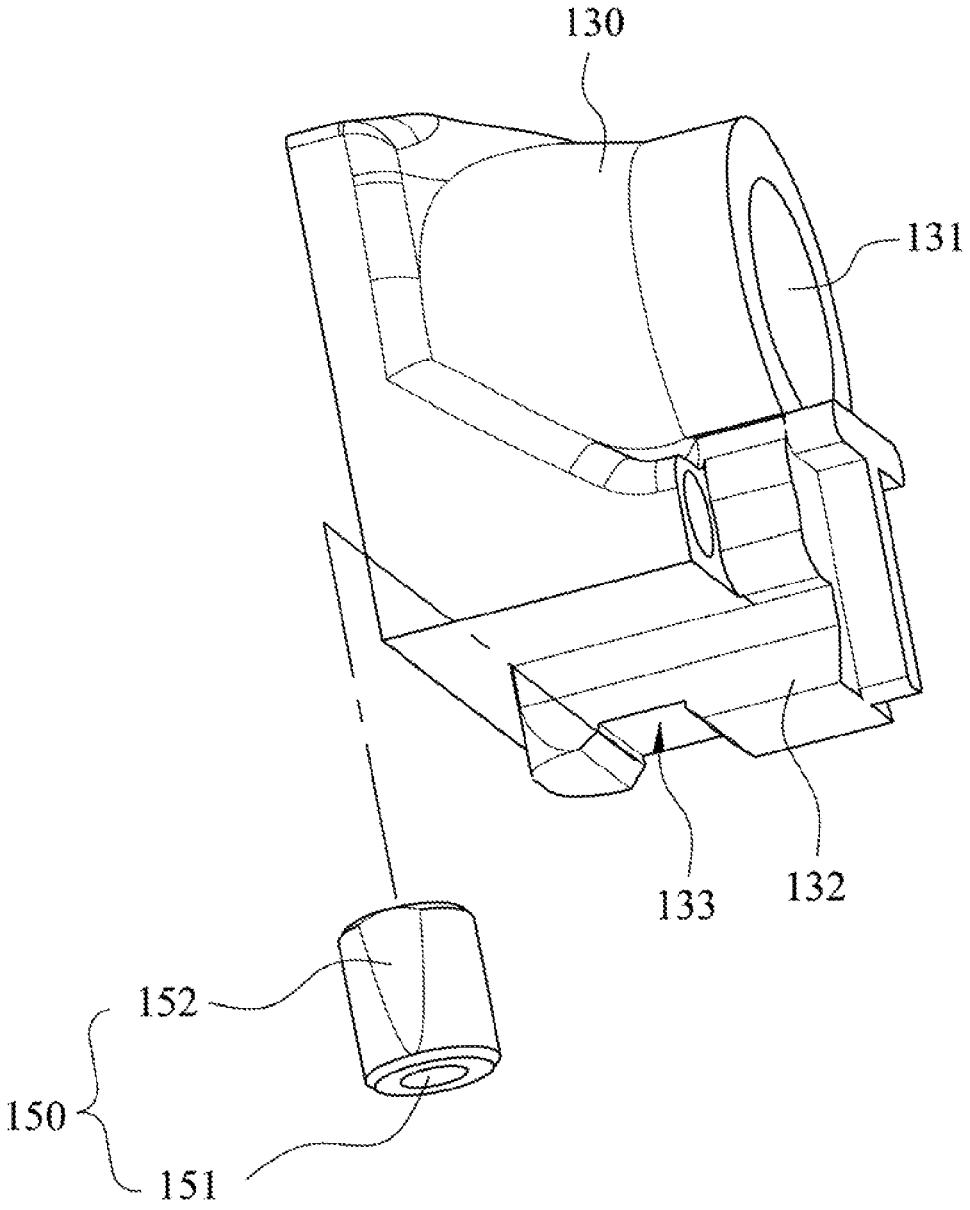
FIG. 3 is another exploded view of a holder and a fitting positioning element in FIG. 2.

Please refer to FIG. 1 to FIG. 3. FIG. 1 is a three-dimensional view of a cutting tool holding device 100 according to the 1st embodiment of the present disclosure. FIG. 2 is an exploded view of the cutting tool holding device 100 shown in FIG. 1. FIG. 3 is another exploded view of a holder 130 and a fitting positioning element 150 shown in FIG. 2. The cutting tool holding device 100 is for holding a cutting tool B (shown in FIG. 5). The cutting tool holding device 100 includes a base 110, a cutting tool holder 120, a screw element 115, a fitting positioning element 150 and a pulling element 160. The cutting tool holder 120 is assembled on the base 110. The screw element 115, the fitting positioning element 150 and the pulling element 160 are inserted in the base 110.

The base 110 includes a first abutting portion 111, a second abutting portion 112, a fitting positioning hole 113 and a fixing screw hole 114. The first abutting portion 111 is connected with the second abutting portion 112. The first abutting portion 111 and the second abutting portion 112 define an angle A1. The angle A1 is greater than or equal to 60 degrees and is less than or equal to 120 degrees. Therefore, the assembling stability between the cutting tool holder 120 and the base 110 can be enhanced. Preferably, the angle A1 is equal to 90 degrees. The first abutting portion 111 has an accommodating groove 111*a* formed thereon. The second abutting portion 112 has a receiving hole 112*a* formed thereon. A central axis (not shown) of the receiving hole 112*a* is parallel to an extending direction of the accommodating groove 111*a*. The fitting positioning hole 113 is through the base 110 and communicated with the accommodating groove 111*a*. A central axis (not shown) of the fitting positioning hole 113 is perpendicular to the extending direction of the accommodating groove 111*a*. The fixing screw hole 114 is communicated with the receiving hole 112*a*.

The cutting tool holder 120 is assembled between the first abutting portion 111 and the second abutting portion 112. The cutting tool holder 120 includes a holder 130 and a cutting tool receiving component 140.

The holder 130 includes a fitting hole 131 and an engaging portion 132. A concave portion 133 is formed on the engaging portion 132. The fitting hole 131 is correspondent to the receiving hole 112*a*. The engaging portion 132 is detachably engaged in the accommodating groove 111*a*. The concave portion 133 is communicated with the fitting positioning hole 113 while the engaging portion 132 is engaged in the accommodating groove 111*a*.

The cutting tool receiving component 140 includes a fitting tube 141 and a holding hole 142. The fitting tube 141 is coaxial with the holding hole 142. The fitting tube 141 is fitted into the fitting hole 131 of the holder 130 and the receiving hole 112*a* of the second abutting portion 112. The holding hole 142 is for holding the cutting tool B (shown in FIG. 5).

The screw element 115 has a screw thread formed on an outer surface thereof. Therefore, the screw element 115 can be screwed in the fixing screw hole 114 so as to abut and fix the fitting tube 141 of the cutting tool receiving component 140. According to one example of the present disclosure, the fitting tube 141 of the cutting tool receiving component 140 can have a positioning concave (refer to the positioning concave 441*a* shown in FIG. 9). The positioning concave is correspondent to the screw element 115, so that the abutting and fixing effect between the screw element 115 and the fitting tube 141 can be enhanced, and the assembling ability between the base 110 and the cutting tool receiving component 140 can be enhanced.

The fitting positioning element 150 is movably disposed in the fitting positioning hole 113. The fitting positioning element 150 is configured to press against the concave portion 133 of the engaging portion 132. A first screw hole 151 is formed at an end of the fitting positioning element 150. In the embodiment, the first screw hole 151 goes through the fitting positioning element 150 and is a through hole. In other embodiment, the first screw hole 151 can be configured as not going through the fitting positioning element 150. A first inclined plane 152 is formed on an outer surface of the fitting positioning element 150. Thus, the fitting positioning element 150 has a cross-sectional area changing gradually along an extending direction thereof, and the fitting positioning element 150 presses against the concave portion 133 of the engaging portion 132 via the first inclined plane 152.

The pulling element 160 is restrictedly disposed in the fitting positioning hole 113. The pulling element 160 includes a first screw portion 161 and a first position-limited portion 162. The first position-limited portion 162 is connected with the first screw portion 161, and a cross-sectional area of the first position-limited portion 162 is greater than a cross-sectional area of the first screw portion 161.

Figure 4:
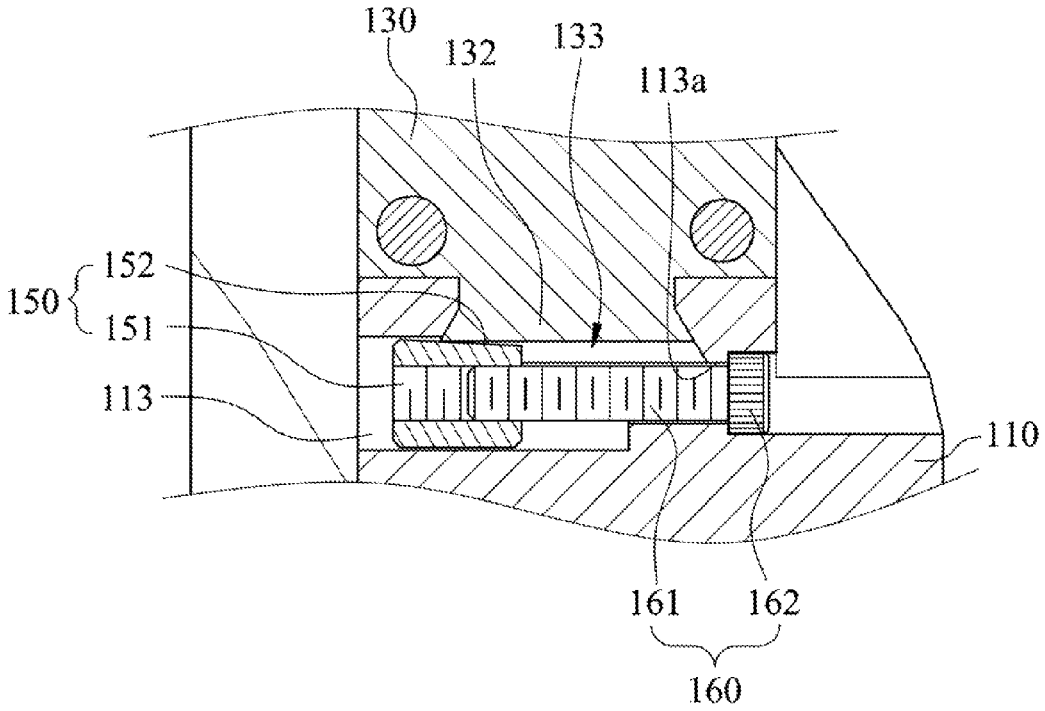
FIG. 4 is a cross-sectional view taken along line 4-4 of the cutting tool holding device shown in FIG. 1.

Please refer to FIG. 4, which is a cross-sectional view taken along line 4-4 of the cutting tool holding device 100 shown in FIG. 1. The fitting positioning hole 113 of the base 110 includes a first narrow portion 113*a*. The fitting positioning element 150 is disposed at a side of the first narrow portion 113*a*. The first position-limited portion 162 of the pulling element 160 is disposed at the other side of the first narrow portion 113*a*, and the first screw portion 161 of the pulling element 160 inserts through the first narrow portion 113*a* and is engaged with the first screw hole 151 of the fitting positioning element 150. The cross-sectional area of the first position-limited portion 162 is greater than a cross-sectional area of the first narrow portion 113*a*. Therefore, the displacement of first position-limited portion 162 from one side to the other side of the first narrow portion 113*a* can be prevented, so that the position of the pulling element 160 can be limited. Furthermore, with the engagement between the first screw portion 161 and the first screw hole 151, the fitting positioning element 150 is driven by the pulling element 160 to move in the fitting positioning hole 113 for changing a pressing degree between the fitting positioning element 150 and the concave portion 133 of the engaging portion 132.

From the above, with the pressing degree between the fitting positioning element 150 and the concave portion 133 of the engaging portion 132, a looseness between the base 110 and the cutting tool holder 120 can be prevented, so that the load value for the reaction force of the base 110 and the cutting tool holder 120 can be enhanced. Accordingly, the lifetime of the base 110 and the cutting tool holder 120 can be prolonged, and the maintaining cost can be reduced. Moreover, with the engagement between the first screw portion 161 of the pulling element 160 and the first screw hole 151 of the fitting positioning element 150, a user can rotate the pulling element 160 so as to precisely adjust the pressing degree between the fitting positioning element 150, the base 110 and the cutting tool holder 120. Therefore, the cutting tool holding device 100 according to the present disclosure further has the advantages of easy operation and high adjustment precision.

Figure 5:
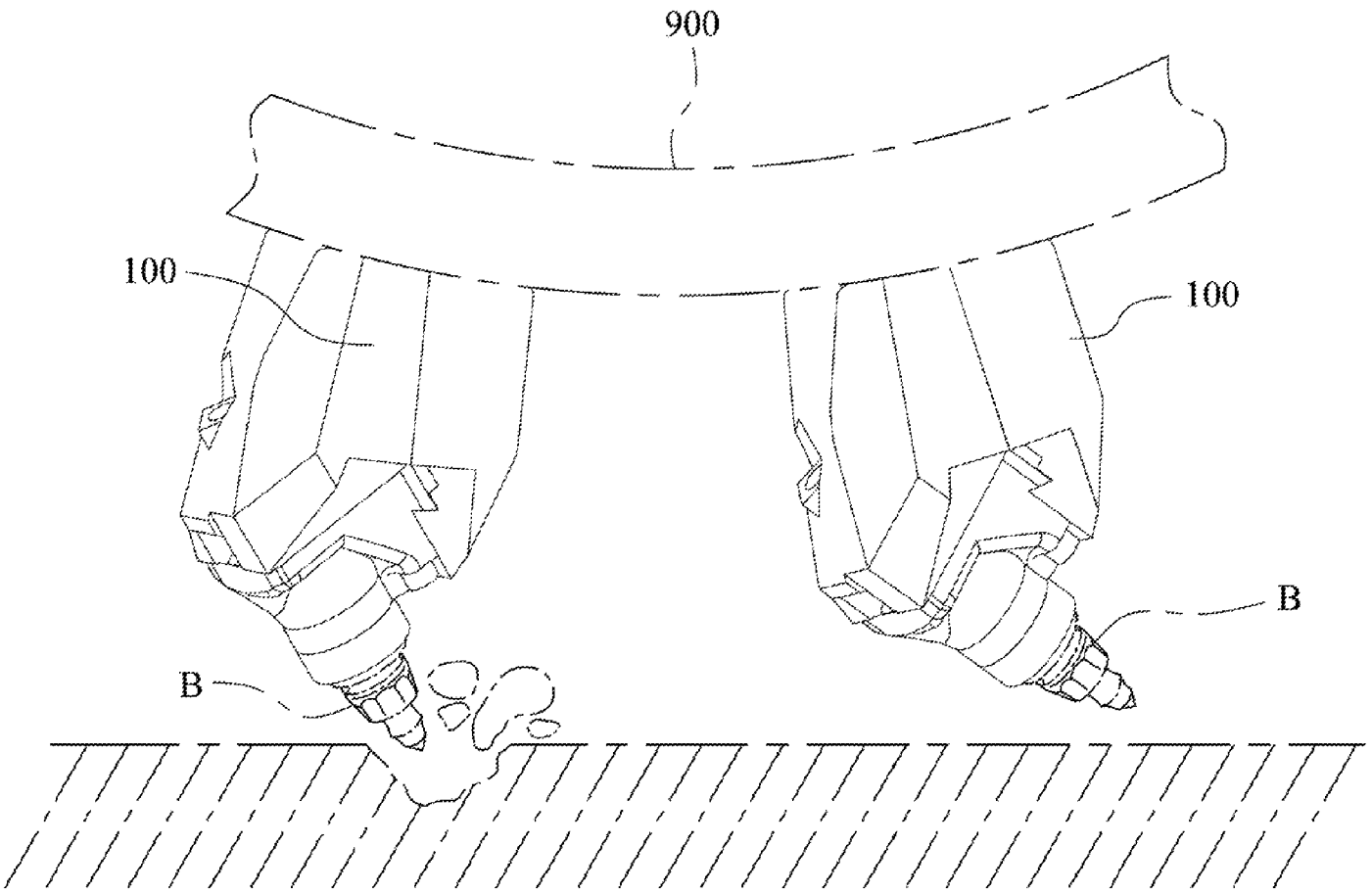
FIG. 5 is an operating schematic view of the cutting tool holding device shown in FIG. 1.

Please refer to FIG. 5, which is an operating schematic view of the cutting tool holding device 100 shown in FIG. 1. The cutting tool holding device 100 is mounted on a machinery 900 for applying a surface roughness treatment to a road. The cutting tool B is received in the cutting tool holding device 100. The cutting tool B is applied to process a processed material, such as the surface of the road. By reinforcing the assembling stability between the base 110 and the cutting tool holder 120, the lifetime of the base 110 and the cutting tool holder 120 can be prolonged, and the maintaining cost can be reduced.

Figure 6:
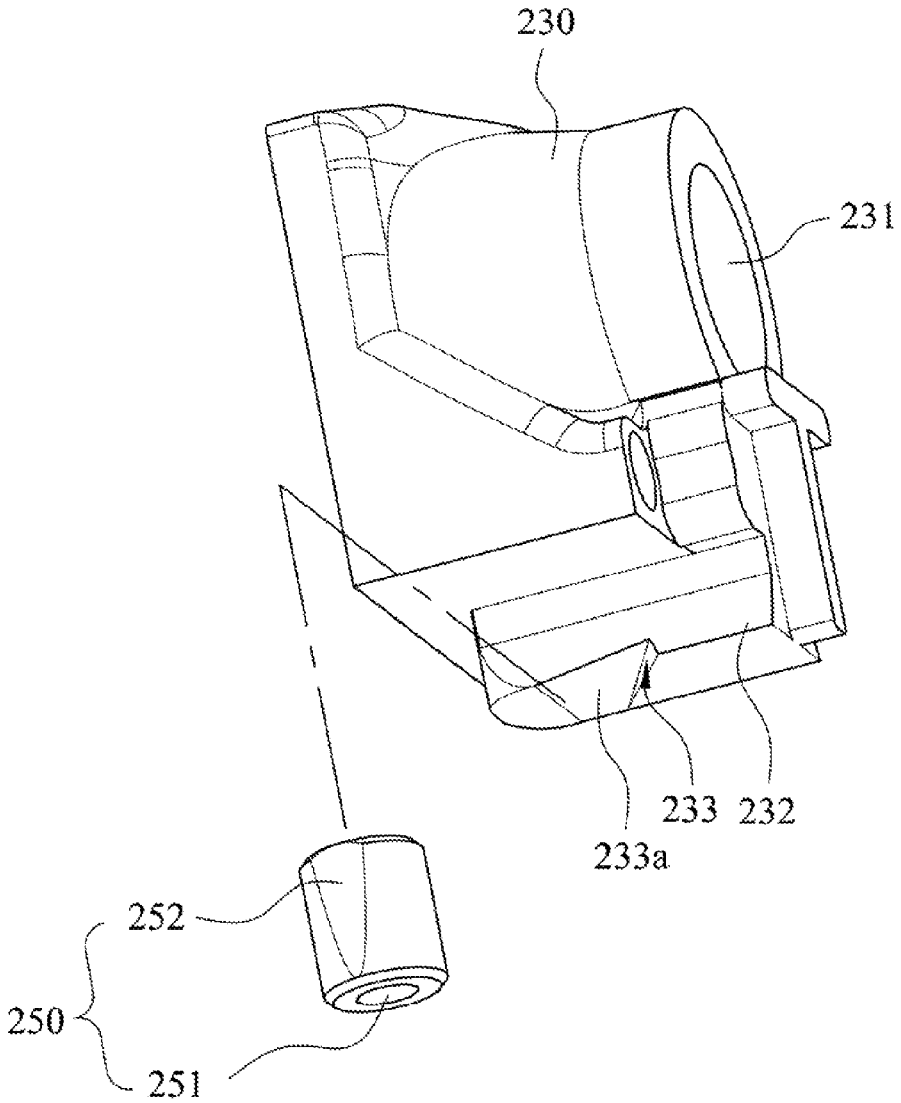
FIG. 6 is an exploded view of a holder and a fitting positioning element of a cutting tool holding device according to the 2nd embodiment of the present disclosure.

Please refer to FIG. 6, which is an exploded view of a holder 230 and a fitting positioning element 250 of a cutting tool holding device according to the 2nd embodiment of the present disclosure. In the 2nd embodiment, the holder 230 includes a fitting hole 231 and an engaging portion 232. A concave portion 233 is formed on the engaging portion 232. The concave portion 233 includes a second inclined plane 233*a*. The fitting positioning element 250 includes a first screw hole 251 and a first inclined plane 252. When the holder 230 and a base (not shown) are assembled, the first inclined plane 252 of the fitting positioning element 250 presses against the second inclined plane 233*a* of the concave portion 233. Therefore, the contact area between the first inclined plane 252 and the concave portion 233 can be enhanced, so that the pressing degree between the fitting positioning element 250 and the concave portion 233 can be enhanced. The rest details of the 2nd embodiment are the same as that of the 1st embodiment, and will not be repeated herein.

Figure 7:
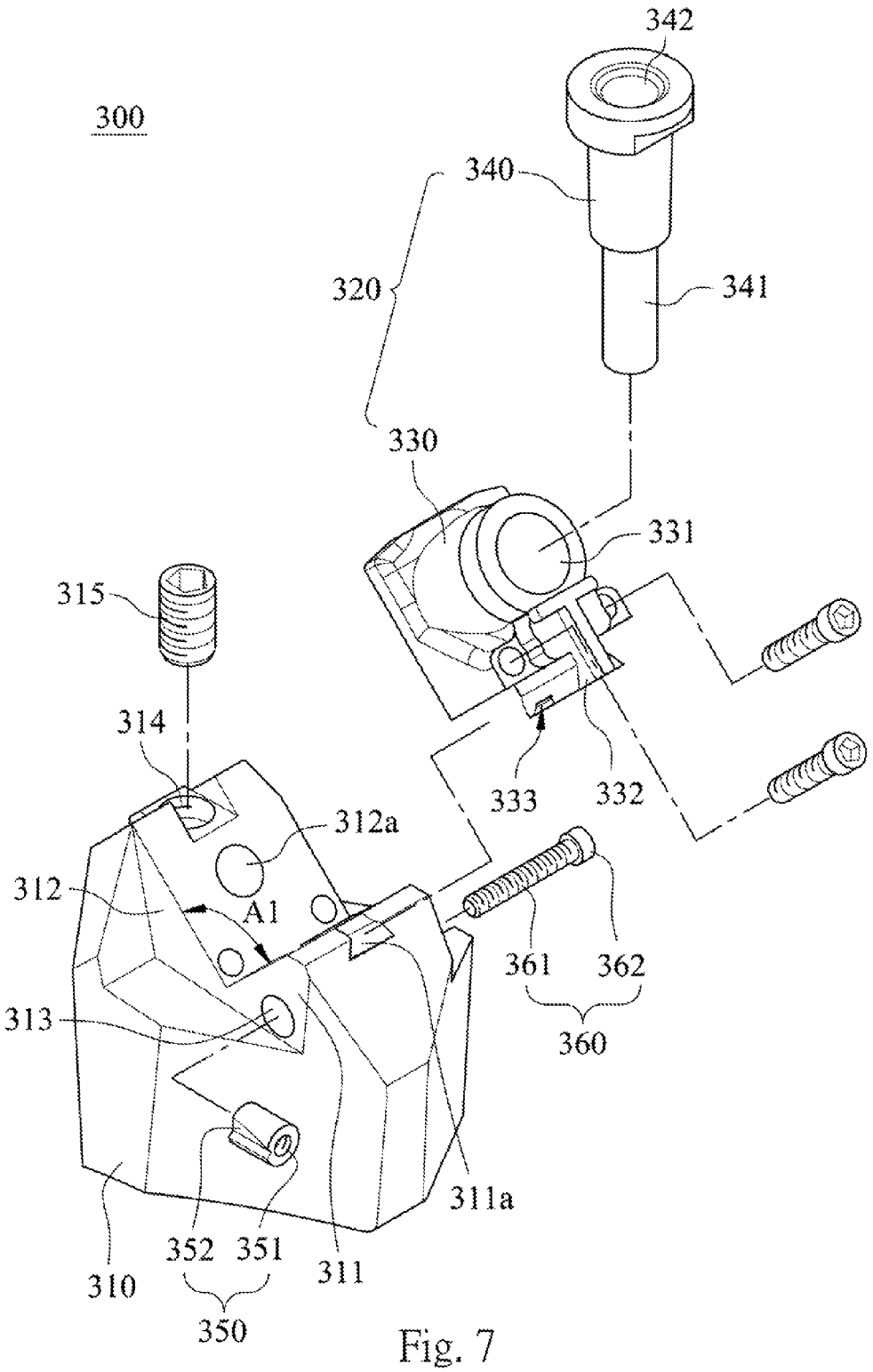
FIG. 7 is an exploded view of a cutting tool holding device according to the 3rd embodiment of the present disclosure.
Figure 8:
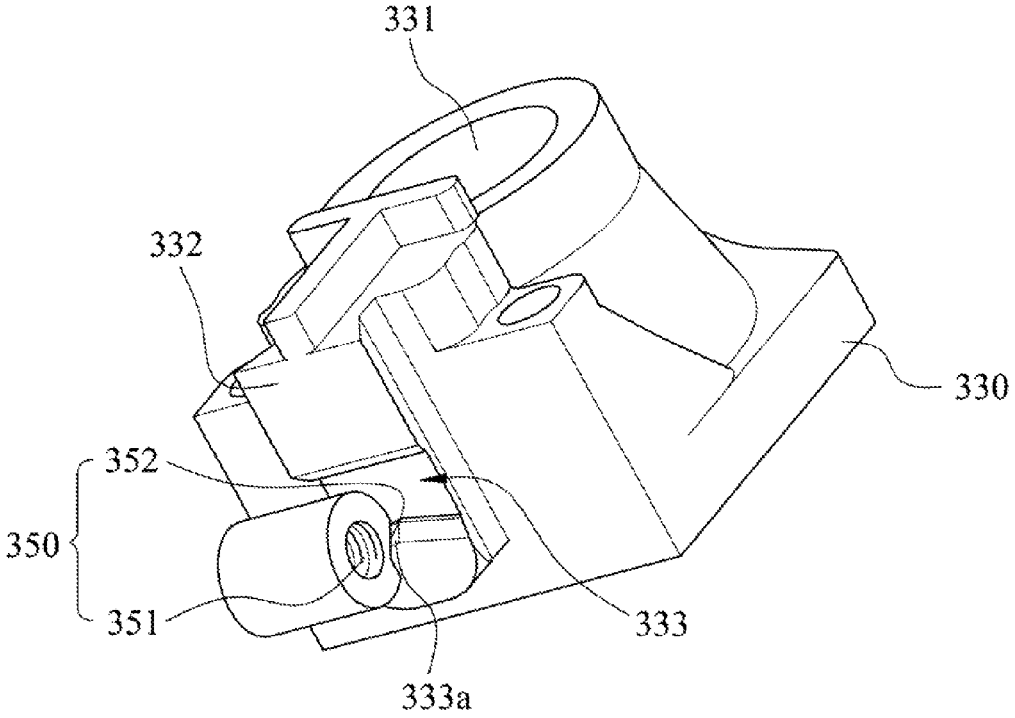
FIG. 8 is an assembling view of a holder and a fitting positioning element shown in FIG. 7.

Please refer to FIG. 7 and FIG. 8. FIG. 7 is an exploded view of a cutting tool holding device 300 according to the 3rd embodiment of the present disclosure. FIG. 8 is an assembling view of a holder 330 and a fitting positioning element 350 shown in FIG. 7. The cutting tool holding device 300 includes a base 310, a cutting tool holder 320, a screw element 315, the fitting positioning element 350 and a pulling element 360. The cutting tool holder 320 is assembled on the base 310. The screw element 315, the fitting positioning element 350 and the pulling element 360 are inserted in the base 310.

The base 310 includes a first abutting portion 311, a second abutting portion 312, a fitting positioning hole 313 and a fixing screw hole 314. The first abutting portion 311 is connected with the second abutting portion 312. The first abutting portion 311 and the second abutting portion 312 define an angle A1. The angle A1 is greater than or equal to 60 degrees and is less than or equal to 120 degrees. Therefore, the assembling stability between the cutting tool holder 320 and the base 310 can be enhanced. Preferably, the angle A1 is equal to 90 degrees. The first abutting portion 311 has an accommodating groove 311*a* formed thereon. The second abutting portion 312 has a receiving hole 312*a* formed thereon. A central axis (not shown) of the receiving hole 312*a* is parallel to an extending direction of the accommodating groove 311*a*. The fitting positioning hole 313 is through the base 310 and communicated with the accommodating groove 311*a*. A central axis (not shown) of the fitting positioning hole 313 is perpendicular to the extending direction of the accommodating groove 311*a*. The fixing screw hole 314 is communicated with the receiving hole 312*a*.

The cutting tool holder 320 is assembled between the first abutting portion 311 and the second abutting portion 312. The cutting tool holder 320 includes the holder 330 and a cutting tool receiving component 340.

The holder 330 includes a fitting hole 331 and an engaging portion 332. A concave portion 333 is formed on the engaging portion 332. One side of the concave portion 333 is formed in a ridge shape which includes two symmetrical second inclined plane 333*a*.

The cutting tool receiving component 340 includes a fitting tube 341 and a holding hole 342. The fitting tube 341 is coaxial with the holding hole 342. The fitting tube 341 is fitted into the fitting hole 331 of the holder 330 and the receiving hole 312*a* of the second abutting portion 312. The holding hole 342 is for holding a cutting tool (not shown).

The screw element 315 has a screw thread formed on an outer surface thereof. Therefore, the screw element 315 can be screwed in the fixing screw hole 314 so as to abut and fix the fitting tube 341 of the cutting tool receiving component 340.

The fitting positioning element 350 is movably disposed in the fitting positioning hole 313. The fitting positioning element 350 is configured to press against the concave portion 333 of the engaging portion 332. A first screw hole 351 is formed at an end of the fitting positioning element 350. In the embodiment, the first screw hole 351 goes through the fitting positioning element 350 and is a through hole. In other embodiment, the first screw hole 351 can be configured as not going through the fitting positioning element 350. A first inclined plane 352 is formed on an outer surface of the fitting positioning element 350. Thus, the fitting positioning element 350 has a cross-sectional area changing gradually along an extending direction thereof, and the fitting positioning element 350 presses against the second inclined plane 333*a* of the concave portion 333 of the engaging portion 332 via the first inclined plane 352.

The pulling element 360 is restrictedly disposed in the fitting positioning hole 313. The pulling element 360 includes a first screw portion 361 and a first position-limited portion 362. The first position-limited portion 362 is connected with the first screw portion 361. The first screw portion 361 of the pulling element 360 is engaged with the first screw hole 351 of the fitting positioning element 350. Therefore, the fitting positioning element 350 is driven by the pulling element 360 to move in the fitting positioning hole 313 for changing a pressing degree between the fitting positioning element 350 and the second inclined plane 333*a* of the concave portion 333.

Figure 9:
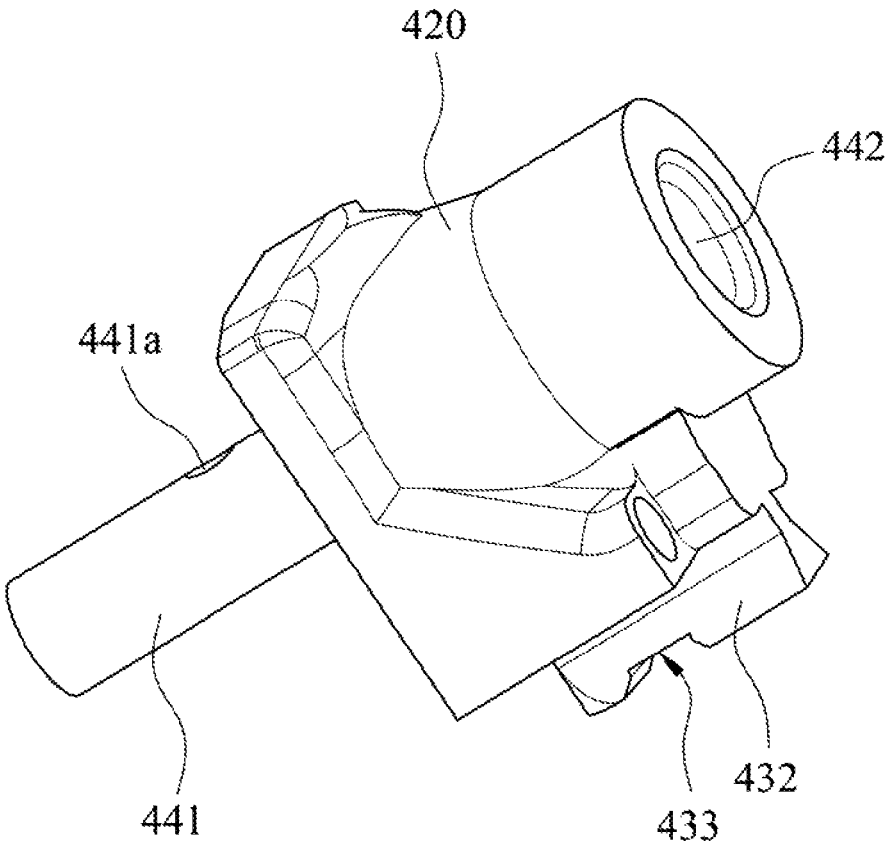
FIG. 9 is a three-dimensional view of a cutting tool holder of a cutting tool holding device according to the 4th embodiment of the present disclosure.

Please refer to FIG. 9, which is a three-dimensional view of cutting tool holder 420 of a cutting tool holding device according to the 4th embodiment of the present disclosure. In the 4th embodiment, the cutting tool holder 420 includes an engaging portion 432, a fitting tube 441 and a holding hole 442. A concave portion 433 is formed on the engaging portion 432. The positioning concave 441*a* is formed on the fitting tube 441. The positioning concave 441*a* is correspondent to a screw element (not shown), so that the abutting and fixing effect between the screw element and the fitting tube 441 can be enhanced. In the 4th embodiment, the cutting tool holder 420 is integrally formed and cannot be disassembled into a holder and a cutting tool receiving component. Accordingly, the structure of the cutting tool holder 420 is simpler. The rest details of the 4th embodiment are the same as that of the 1st embodiment, and will not be repeated herein.

Figure 10:
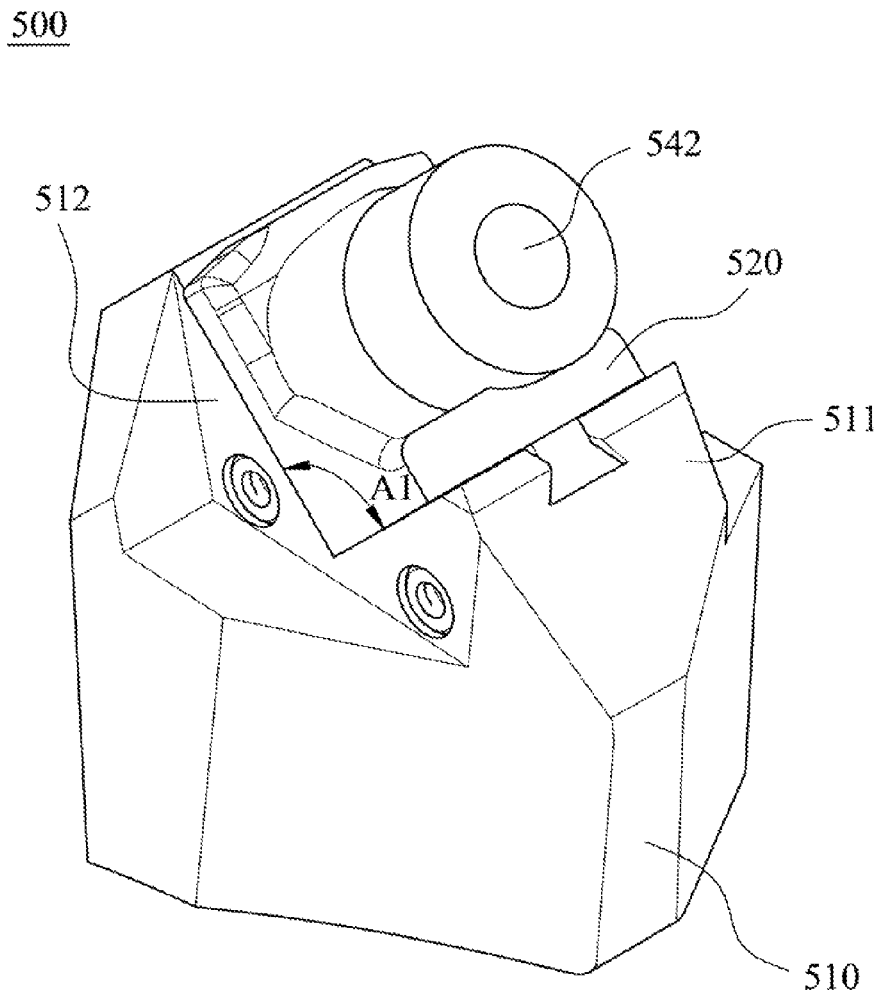
FIG. 10 is a three-dimensional view of a cutting tool holding device according to the 5th embodiment of the present disclosure.
Figure 11:
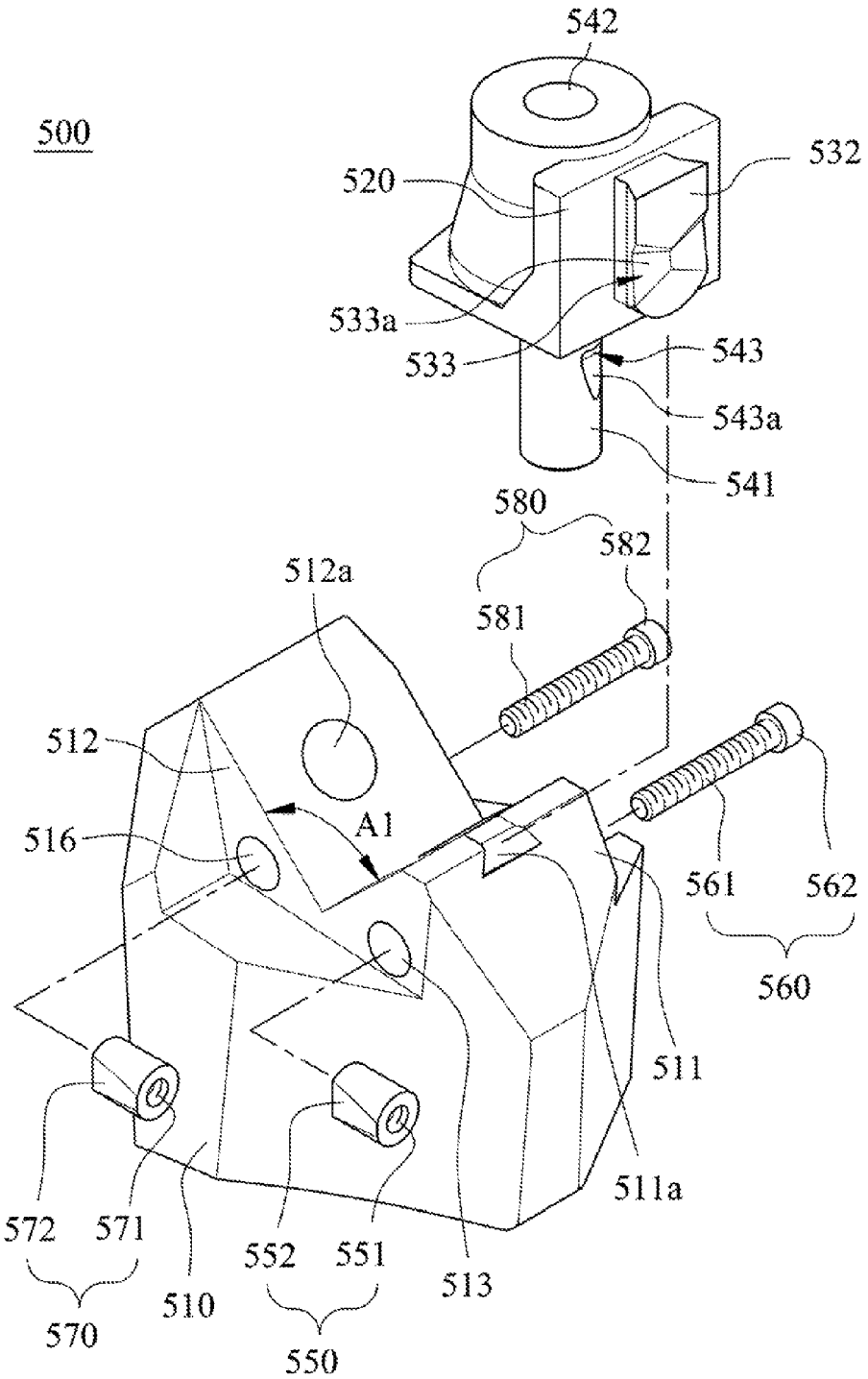
FIG. 11 is an exploded view of the cutting tool holding device shown in FIG. 10.

Please refer to FIG. 10 and FIG. 11. FIG. 10 is a three-dimensional view of a cutting tool holding device 500 according to the 5th embodiment of the present disclosure. FIG. 11 is an exploded view of the cutting tool holding device 500 shown in FIG. 10. The cutting tool holding device 500 includes a base 510, a cutting tool holder 520, a fitting positioning element 550, a pulling element 560, a tube positioning element 570 and a dragging element 580. The cutting tool holder 520 is assembled on the base 510. The fitting positioning element 550, the pulling element 560, the tube positioning element 570 and the dragging element 580 are inserted in the base 510.

The base 510 includes a first abutting portion 511, a second abutting portion 512, a fitting positioning hole 513 and a tube positioning hole 516. The first abutting portion 511 is connected with the second abutting portion 512. The first abutting portion 511 and the second abutting portion 512 define an angle A1. The angle A1 is greater than or equal to 60 degrees and is less than or equal to 120 degrees. Therefore, the assembling stability between the cutting tool holder 520 and the base 510 can be enhanced. Preferably, the angle A1 is equal to 90 degrees. The first abutting portion 511 has an accommodating groove 511*a* formed thereon. The second abutting portion 512 has a receiving hole 512*a* formed thereon. A central axis (not shown) of the receiving hole 512*a* is parallel to an extending direction of the accommodating groove 511*a*. The fitting positioning hole 513 is through the base 510 and communicated with the accommodating groove 511*a*. A central axis (not shown) of the fitting positioning hole 513 is perpendicular to the extending direction of the accommodating groove 511*a*. The tube positioning hole 516 is through the base 510 and communicated with the receiving hole 512*a*. A central axis of the tube positioning hole 516 is perpendicular to a central axis of the receiving hole 512*a*.

The cutting tool holder 520 is assembled between the first abutting portion 511 and the second abutting portion 512. The cutting tool holder 520 includes an engaging portion 532, a fitting tube 541 and a holding hole 542. The holding hole 542 is coaxial with the fitting tube 541 and is for holding a cutting tool (not shown). A concave portion 533 is formed on the engaging portion 532, and the concave portion 533 includes a second inclined plane 533*a*. A depressed portion 543 is formed on the fitting tube 541, and the depressed portion 543 includes a fourth inclined plane 543*a*. The engaging portion 532 is detachably engaged in the accommodating groove 511*a*. The concave portion 533 is communicated with the fitting positioning hole 513 and the depressed portion 543 is communicated with the tube positioning hole 516 while the engaging portion 532 is engaged in the accommodating groove 511*a* and the fitting tube 541 is fitted into the receiving hole 512*a*.

The fitting positioning element 550 is movably disposed in the fitting positioning hole 513. A first screw hole 551 is formed at an end of the fitting positioning element 550. In the embodiment, the first screw hole 551 goes through the fitting positioning element 550 and is a through hole. In other embodiment, the first screw hole 551 can be configured as not going through the fitting positioning element 550. A first inclined plane 552 is formed on an outer surface of the fitting positioning element 550. Thus, the fitting positioning element 550 has a cross-sectional area changing gradually along an extending direction thereof, and the fitting positioning element 550 presses against the second inclined plane 533*a* of the concave portion 533 of the engaging portion 532 via the first inclined plane 552. Therefore, the contact area between the fitting positioning element 550 and the concave portion 533 can be enhanced, so that the pressing degree between the fitting positioning element 550 and the concave portion 533 can be enhanced.

The tube positioning element 570 is movably disposed in the tube positioning hole 516. A second screw hole 571 is formed at an end of the tube positioning element 570. In the embodiment, the second screw hole 571 goes through the tube positioning element 570 and is a through hole. In other embodiment, the second screw hole 571 can be can be configured as not going through the tube positioning element 570. A third inclined plane 572 is formed on an outer surface of the tube positioning element 570. Thus, the tube positioning element 570 has a cross-sectional area changing gradually along an extending direction thereof, and the tube positioning element 570 presses against the fourth inclined plane 543*a* of the depressed portion 543 of the fitting tube 541 via the third inclined plane 572. Therefore, the contact area between the tube positioning element 570 and the depressed portion 543 can be enhanced, so that the pressing degree between the tube positioning element 570 and the depressed portion 543 can be enhanced.

The pulling element 560 is restrictedly disposed in the fitting positioning hole 513. The pulling element 560 includes a first screw portion 561 and a first position-limited portion 562. The first position-limited portion 562 is connected with the first screw portion 561. The first screw portion 561 of the pulling element 560 is engaged with the first screw hole 551 of the fitting positioning element 550. Therefore, the fitting positioning element 550 is driven by the pulling element 560 to move in the fitting positioning hole 513 for changing a pressing degree between the fitting positioning element 550 and the second inclined plane 533*a* of the concave portion 533.

The dragging element 580 is restrictedly disposed in the tube positioning hole 516. The dragging element 580 includes a second screw portion 581 and a second position-limited portion 582. The second position-limited portion 582 is connected with the second screw portion 581. The second screw portion 581 of the dragging element 580 is engaged with the second screw hole 571 of the tube positioning element 570. Therefore, the tube positioning element 570 is driven by the dragging element 580 to move in the tube positioning hole 516 for changing a pressing degree between the tube positioning element 570 and the fourth inclined plane 543*a* of the depressed portion 543.

Figure 12:
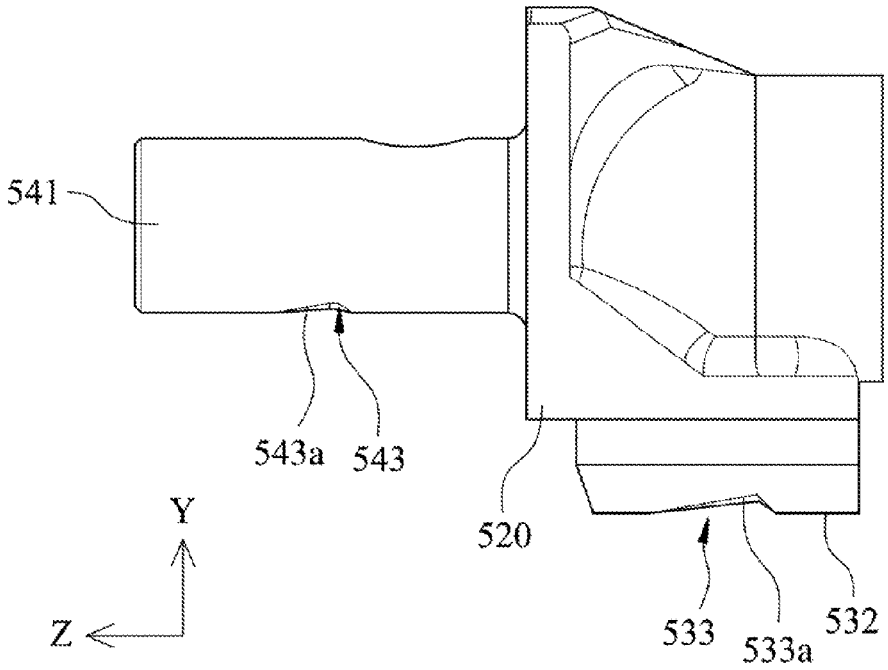
FIG. 12 is a side view of a cutting tool holder shown in FIG. 11.
Figure 13:
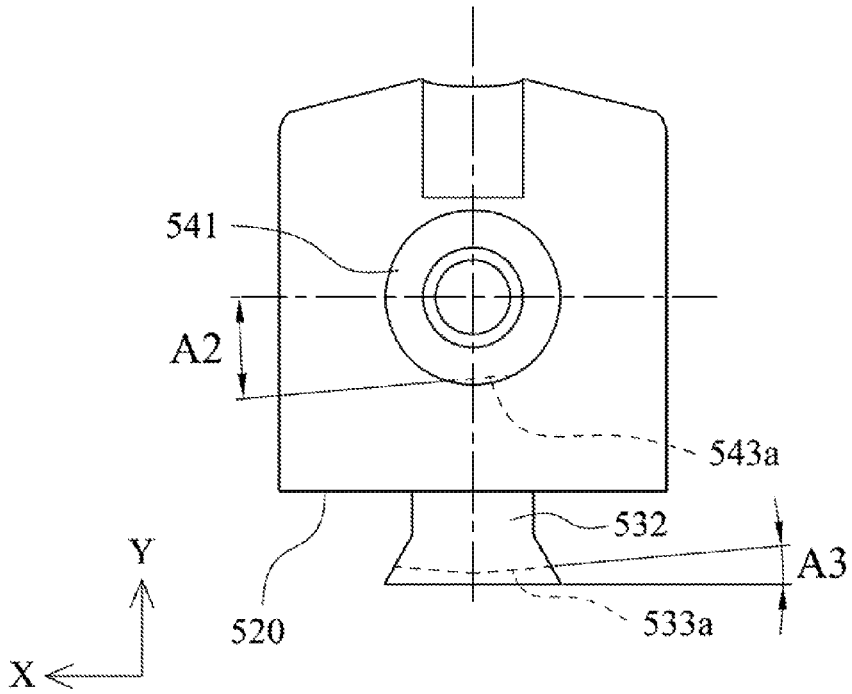
FIG. 13 is a rear view of the cutting tool holder shown in FIG. 12.

Please refer to FIG. 12 and FIG. 13. FIG. 12 is a side view of the cutting tool holder 520 shown in FIG. 11. FIG. 13 is a rear view of the cutting tool holder 520 shown in FIG. 12. As shown in FIG. 12 and FIG. 13, the second inclined plane 533*a* and the fourth inclined plane 543*a* are oblique planes in the embodiment. Therefore, the assembling stability between the base 510 and the cutting tool holder 520 can be further enhanced. Specifically, for a virtual orthogonal coordinate system, the second inclined plane 533*a* and the fourth inclined plane 543*a* are not parallel to nor perpendicular to any of the X-Y plane, the X-Z plane and the Y-Z plane. The Z axis of the virtual orthogonal coordinate system is defined by the direction that the cutting tool fitted into the cutting tool holder 520. The X axis is defined by the central axis of the fitting positioning hole 513. The Y axis is defined by the X axis and the Z axis. According to one embodiment of the present disclosure, an angle A2 between the second inclined plane 533*a* and the X axis is ranging from 4 degrees to 10 degrees. Preferably, the angle A2 between the second inclined plane 533*a* and the X axis is 5 degrees. An angle A3 between the fourth inclined plane 543*a* and the X axis is ranging from 4 degrees to 10 degrees. Preferably, the angle A3 between the fourth inclined plane 543*a* and the X axis is 5 degrees.

Figure 14:
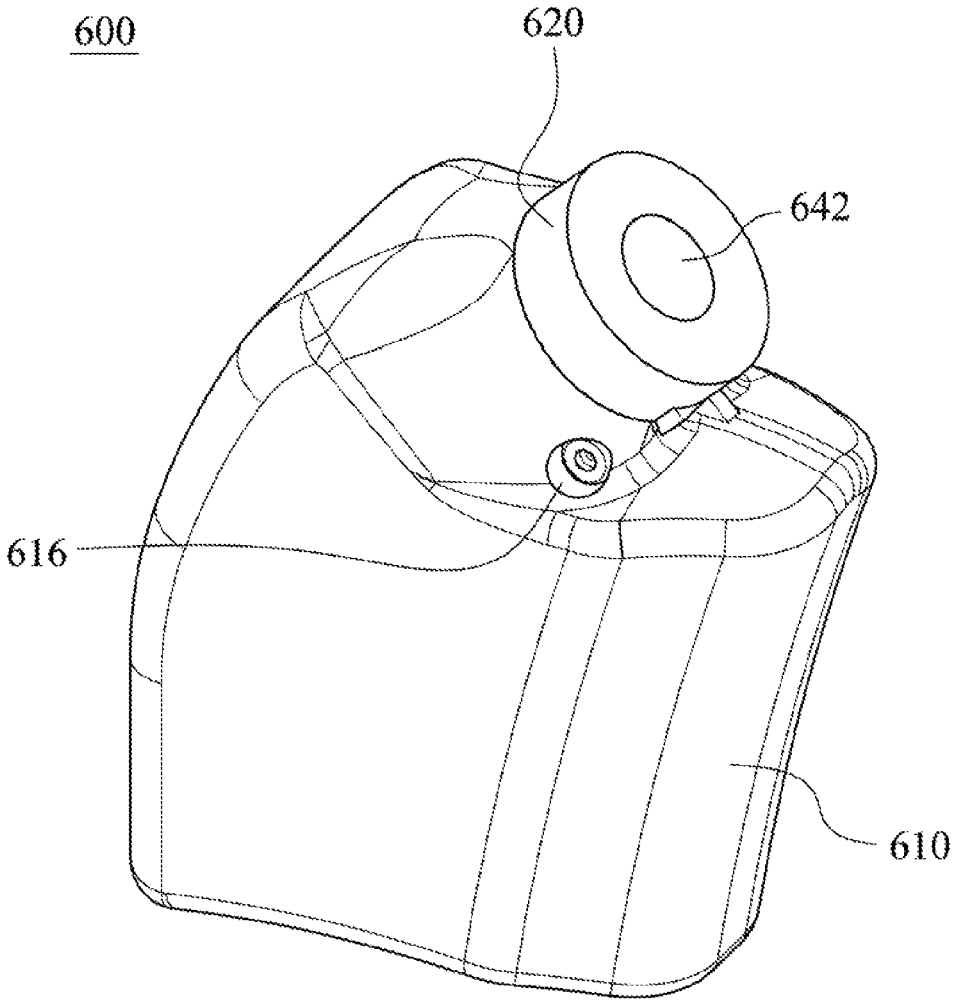
FIG. 14 is a three-dimensional view of a cutting tool holding device according to the 6th embodiment of the present disclosure.
Figure 15:
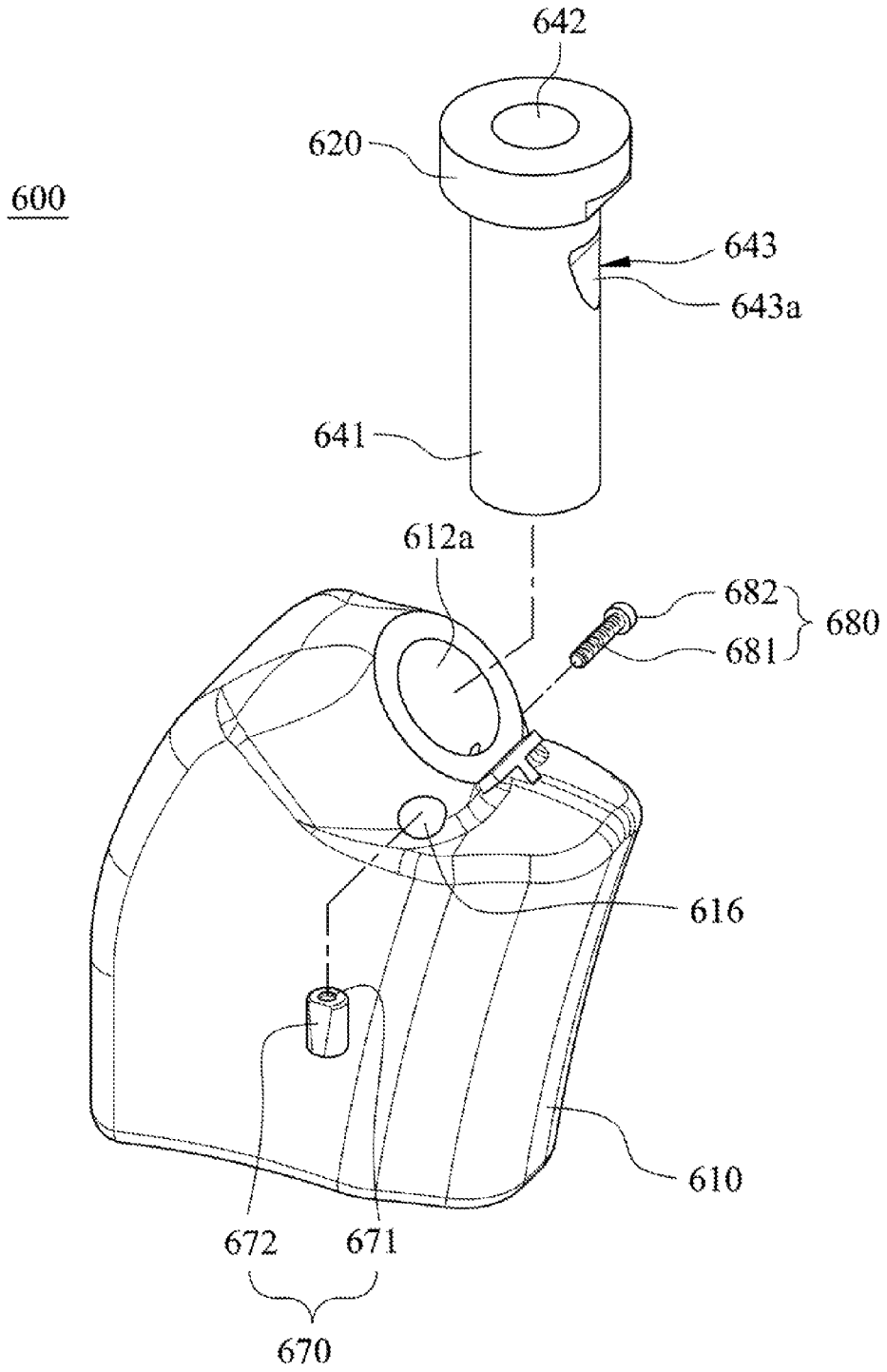
FIG. 15 is an exploded view of the cutting tool holding device shown in FIG. 14.

Please refer to FIG. 14 and FIG. 15. FIG. 14 is a three-dimensional view of a cutting tool holding device 600 according to the 6th embodiment of the present disclosure. FIG. 15 is an exploded view of the cutting tool holding device 600 shown in FIG. 14. The cutting tool holding device 600 is for holding a cutting tool (not shown). The cutting tool holding device 600 includes a base 610, a cutting tool holder 620, a tube positioning element 670 and a dragging element 680.

The base 610 includes a receiving hole 612*a* and a tube positioning hole 616. The tube positioning hole 616 is through the base 610 and communicated with the receiving hole 612*a*, and a central axis of the tube positioning hole 616 is perpendicular to a central axis of the receiving hole 612*a*.

The cutting tool holder 620 is assembled with the base 610. The cutting tool holder 620 includes a fitting tube 641 and a holding hole 642. The holding hole 642 is coaxial with the fitting tube 641 and is for holding a cutting tool. A depressed portion 643 is formed on the fitting tube 641, and the depressed portion 643 includes a fourth inclined plane 643*a*. The depressed portion 643 is communicated with the tube positioning hole 616 while the fitting tube 641 is fitted into the receiving hole 612*a*.

The tube positioning element 670 is movably disposed in the tube positioning hole 616. A second screw hole 671 is formed at an end of the tube positioning element 670. In the embodiment, the second screw hole 671 goes through the tube positioning element 670 and is a through hole. A third inclined plane 672 is formed on an outer surface of the tube positioning element 670. Thus, the tube positioning element 670 has a cross-sectional area changing gradually along an extending direction thereof, and the tube positioning element 670 presses against the fourth inclined plane 643*a* of the depressed portion 643 of the fitting tube 641 via the third inclined plane 672. Therefore, the contact area between the tube positioning element 670 and the depressed portion 643 can be enhanced, so that the pressing degree between the tube positioning element 670 and the depressed portion 643 can be enhanced.

The dragging element 680 is restrictedly disposed in the tube positioning hole 616. The dragging element 680 includes a second screw portion 681 and a second position-limited portion 682. The second position-limited portion 682 is connected with the second screw portion 681. The second screw portion 681 of the dragging element 680 is engaged with the second screw hole 671 of the tube positioning element 670. Therefore, the tube positioning element 670 is driven by the dragging element 680 to move in the tube positioning hole 616 for changing a pressing degree between the tube positioning element 670 and the fourth inclined plane 643*a* of the depressed portion 643.

Figure 16:
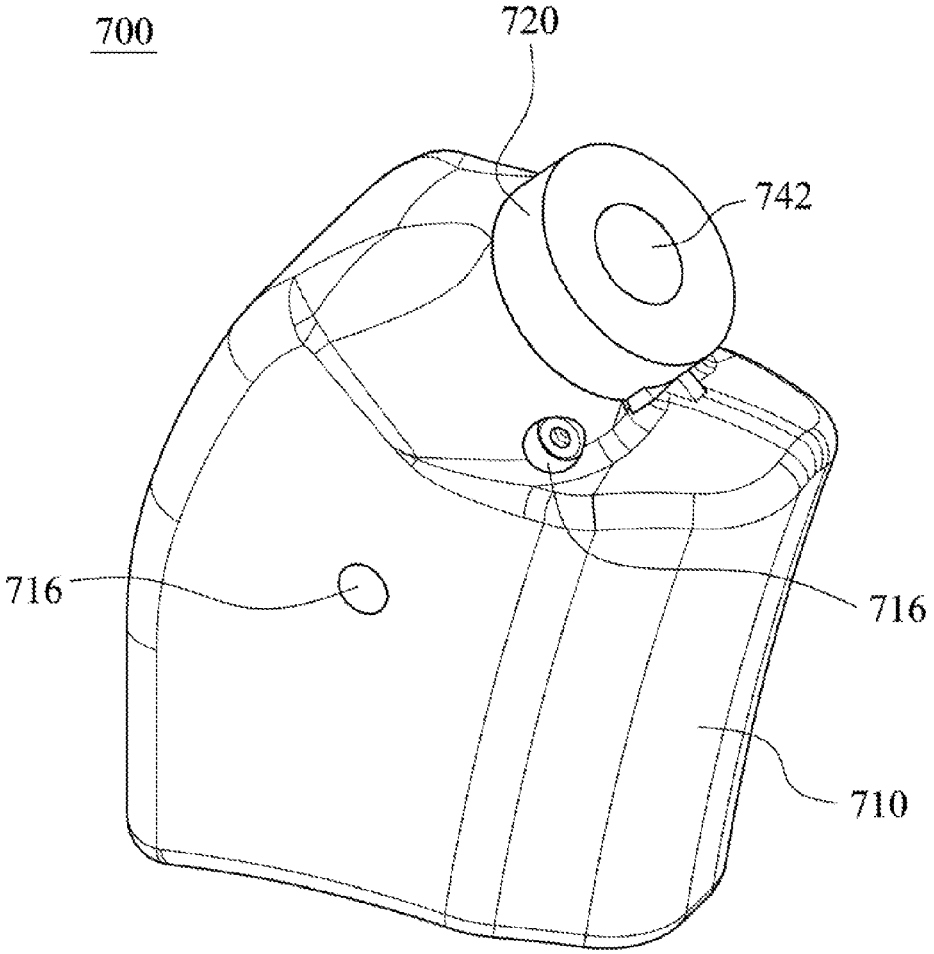
FIG. 16 is a three-dimensional view of a cutting tool holding device according to the 7th embodiment of the present disclosure.
Figure 17:
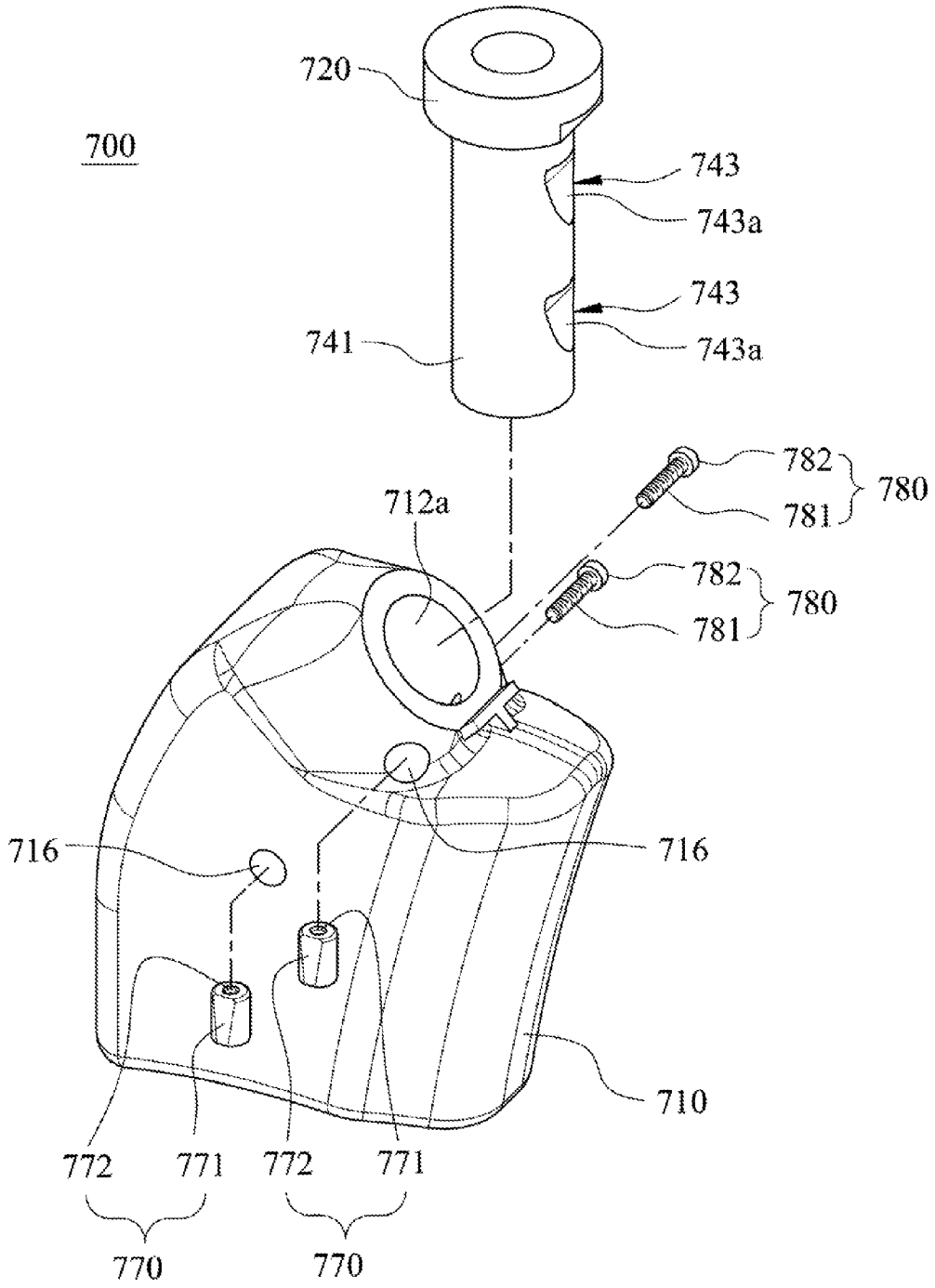
FIG. 17 is an exploded view of the cutting tool holding device shown in FIG. 16.

Please refer to FIG. 16 and FIG. 17. FIG. 16 is a three-dimensional view of a cutting tool holding device 700 according to the 7th embodiment of the present disclosure. FIG. 17 is an exploded view of the cutting tool holding device 700 shown in FIG. 16. The cutting tool holding device 700 includes a base 710, a cutting tool holder 720, two tube positioning elements 770 and two dragging elements 780. The base 710 includes two tube positioning holes 716. The tube positioning holes 716 are separately through the base 710. The cutting tool holder 720 includes a holding hole 742 and a fitting tube 741. Two depressed portions 743 are formed on the fitting tube 741. The two tube positioning elements 770 are disposed in the two tube positioning holes 716, respectively. Each of the tube positioning elements 770 includes a second screw hole 771 and a third inclined plane 772. The two dragging elements 780 are restrictedly disposed in the two tube positioning holes 716, respectively. Each of the dragging element 780 includes a second screw portion 781 and a second position-limited portion 782. The assembling stability between the base 710 and the cutting tool holder 720 can be further enhanced by increasing the number of the tube positioning elements 770, the dragging elements 780 and the depressed portions 743. The rest details of the 7th embodiment are the same as that of the 6th embodiment, and will not be repeated herein.

According to the forgoing embodiments, by driving the fitting positioning element to move in the fitting positioning hole with the pulling element, the pressing degree between the fitting positioning element and the engaging portion can be changed. Alternatively, by driving the tube positioning element to move in the tube positioning hole with the dragging element, the pressing degree between the tube positioning element and the fitting tube can be changed. Therefore, the assembling stability between the base and the cutting tool holder can be reinforced, which can enhance the load value for the reaction force of the base and the cutting tool holder, and can further to prolong the lifetime of the cutting tool holder and the base, and can reduce the cost of replacement and maintenance.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

The invention claimed is:

1. A cutting tool holding device for holding a cutting tool, the cutting tool holding device comprising:

a base, comprising:

a first abutting portion having an accommodating groove formed thereon;

a second abutting portion connected with the first abutting portion and defining an angle with the first abutting portion, wherein the angle is greater than or equal to 60 degrees and is less than or equal to 120 degrees, a receiving hole is formed on the second abutting portion, and a central axis of the receiving hole is parallel to an extending direction of the accommodating groove; and a fitting positioning hole through the base and communicated with the accommodating groove, wherein a central axis of the fitting positioning hole is perpendicular to the extending direction of the accommodating groove;

a cutting tool holder assembled between the first abutting portion and the second abutting portion of the base, the cutting tool holder comprising:

a holder comprising a fitting hole and an engaging portion, wherein the fitting hole is aligned with the receiving hole, the engaging portion is detachably engaged in the accommodating groove, a concave portion is formed on the engaging portion, and the concave portion is communicated with the fitting positioning hole while the engaging portion is engaged in the accommodating groove; and a cutting tool receiving component comprising a fitting tube and a holding hole, wherein the fitting tube is fitted into the fitting hole of the holder and the receiving hole of the second abutting portion, and the holding hole is coaxial with the fitting tube and is for holding the cutting tool;

a fitting positioning element movably disposed in the fitting positioning hole, wherein the fitting positioning element is configured to press against the concave portion of the engaging portion, a first screw hole is formed at an end of the fitting positioning element, and the fitting positioning element has a cross-sectional area changing gradually along an extending direction thereof; and a pulling element disposed in the fitting positioning hole, wherein the pulling element comprises a first screw portion, the first screw portion is engaged with the first screw hole, whereby the fitting positioning element is driven by the pulling element to move in the fitting positioning hole for changing a pressing degree between the fitting positioning element and the concave portion of the engaging portion.

2. The cutting tool holding device of claim 1, wherein:

the base further comprises a fixing screw hole communicated with the receiving hole; and the cutting tool holding device further comprises a screw element screwed in the fixing screw hole, and the screw element is configured to abut and fix the fitting tube of the cutting tool receiving component.

3. The cutting tool holding device of claim 1, wherein:

the fitting positioning hole comprises a first narrow portion, and the fitting positioning element is disposed at a side of the first narrow portion; and the pulling element further comprises a first position-limited portion connected with the first screw portion, a cross-sectional area of the first position-limited portion is greater than a cross-sectional area of the first narrow portion, the first position-limited portion is disposed at the other side of the first narrow portion, and the first screw portion inserts through the first narrow portion and is engaged with the first screw hole of the fitting positioning element.

4. The cutting tool holding device of claim 1, wherein the angle defined by the first abutting portion and the second abutting portion is 90 degrees.

5. The cutting tool holding device of claim 1, wherein the fitting positioning element further comprises a first inclined plane formed on an outer surface thereof, and the first inclined plane is configured to press against the concave portion of the engaging portion.

6. The cutting tool holding device of claim 5, wherein the concave portion of the engaging portion comprises a second inclined plane, and the first inclined plane of the fitting positioning element is configured to press against the second inclined plane.

7. A cutting tool holding device for holding a cutting tool, the cutting tool holding device comprising:

a base, comprising:

a first abutting portion having an accommodating groove formed thereon;

a second abutting portion connected with the first abutting portion and defining an angle with the first abutting portion, wherein the angle is greater than or equal to 60 degrees and is less than or equal to 120 degrees, a receiving hole is formed on the second abutting portion, and a central axis of the receiving hole is parallel to an extending direction of the accommodating groove; and a fitting positioning hole through the base and communicated with the accommodating groove, wherein a central axis of the fitting positioning hole is perpendicular to the extending direction of the accommodating groove;

a cutting tool holder assembled between the first abutting portion and the second abutting portion of the base, the cutting tool holder comprising:

an engaging portion detachably engaged in the accommodating groove, wherein a concave portion is formed on the engaging portion, and the concave portion is communicated with the fitting positioning hole while the engaging portion is engaged in the accommodating groove; and a fitting tube fitted into the receiving hole of the second abutting portion; and a holding hole coaxial with the fitting tube and for holding the cutting tool;

a fitting positioning element movably disposed in the fitting positioning hole, wherein the fitting positioning element is configured to press against the concave portion of the engaging portion, a first screw hole is formed at an end of the fitting positioning element, and the fitting positioning element has a cross-sectional area changing gradually along an extending direction thereof; and a pulling element disposed in the fitting positioning hole, wherein the pulling element comprises a first screw portion, the first screw portion is engaged with the first screw hole, whereby the fitting positioning element is driven by the pulling element to move in the fitting positioning hole for changing a pressing degree between the fitting positioning element and the concave portion of the engaging portion.

8. The cutting tool holding device of claim 7, wherein:

the base further comprises a fixing screw hole communicated with the receiving hole; and the cutting tool holding device further comprises a screw element screwed in the fixing screw hole, and the screw element is configured to abut and fix the fitting tube of the cutting tool holder.

9. The cutting tool holding device of claim 7, wherein:

the base further comprises a tube positioning hole through the base and communicated with the receiving hole, and a central axis of the tube positioning hole is perpendicular to a central axis of the receiving hole;

a depressed portion is formed on the fitting tube of the cutting tool holder, and the depressed portion is communicated with the tube positioning hole while the fitting tube is fitted into the receiving hole;

the cutting tool holding device further comprises a tube positioning element movably disposed in the tube positioning hole, the tube positioning element is configured to press against the depressed portion of the fitting tube, a second screw hole is formed at an end of the tube positioning element, and the tube positioning element has a cross-sectional area changing gradually along an extending direction thereof; and the cutting tool holding device further comprises a dragging element disposed in the tube positioning hole, the dragging element comprises a second screw portion, the second screw portion is engaged with the second screw hole, whereby the tube positioning element is driven by the dragging element to move in the tube positioning hole for changing a pressing degree between the tube positioning element and the depressed portion of the fitting tube.

10. The cutting tool holding device of claim 9, wherein:

the fitting positioning element further comprises a first inclined plane formed on an outer surface thereof, and the first inclined plane is configured to press against the concave portion of the engaging portion; and the tube positioning element further comprises a third inclined plane formed on an outer surface thereof, and the third inclined plane is configured to press against the depressed portion of the fitting tube.

11. The cutting tool holding device of claim 10, wherein:

the concave portion of the engaging portion comprises a second inclined plane, and the first inclined plane of the fitting positioning element is configured to press against the second inclined plane; and the depressed portion of the fitting tube comprises a fourth inclined plane, and the third inclined plane of the tube positioning element is configured to press against the fourth inclined plane.

12. The cutting tool holding device of claim 7, wherein the angle defined by the first abutting portion and the second abutting portion is 90 degrees.

* * * * *